US010403260B2

(12) United States Patent
Eguchi et al.

(10) Patent No.: US 10,403,260 B2
(45) Date of Patent: Sep. 3, 2019

(54) DIGITAL ELECTROACOUSTIC TRANSDUCER APPARATUS

(71) Applicant: AUDIO-TECHNICA CORPORATION, Machida-shi, Tokyo (JP)

(72) Inventors: Toyokazu Eguchi, Inagi (JP); Kenzo Tsuihiji, Suita (JP)

(73) Assignee: AUDIO-TECHNICA CORPORATION, Machida-Shi, Tokyo (JP)

( * ) Notice: Subject to any disclaimer, the term of this patent is extended or adjusted under 35 U.S.C. 154(b) by 0 days.

(21) Appl. No.: 16/104,334

(22) Filed: Aug. 17, 2018

(65) Prior Publication Data

US 2019/0156814 A1 May 23, 2019

(30) Foreign Application Priority Data

Nov. 17, 2017 (JP) ..... 2017-221413

(51) Int. Cl.

| | |
|---|---|
| ***G10K 11/178*** | (2006.01) |
| ***H04R 9/06*** | (2006.01) |
| ***H04R 9/04*** | (2006.01) |
| ***H04R 9/02*** | (2006.01) |

(52) U.S. Cl.

CPC .. *G10K 11/17823* (2018.01); *G10K 11/17853* (2018.01); *H04R 9/025* (2013.01); *H04R 9/046* (2013.01); *H04R 9/06* (2013.01); *G10K 2210/1081* (2013.01); *G10K 2210/3026* (2013.01); *G10K 2210/3027* (2013.01); *G10K 2210/3028* (2013.01); *G10K 2210/3046* (2013.01)

(58) Field of Classification Search

USPC .... 381/71.6, 71.7, 71.1, 73.1, 111, 116, 117, 381/120, 191

See application file for complete search history.

(56) References Cited

U.S. PATENT DOCUMENTS 8,306,244 B2 * 11/2012 Okamura ..... H04R 1/005 381/111
2014/0314245 A1 * 10/2014 Asada ..... H04R 1/1083 381/71.6

FOREIGN PATENT DOCUMENTS

JP 2015-065661 A 4/2015
JP 2017-098993 A 6/2017

* cited by examiner

*Primary Examiner* — Yosef K Laekemariam
(74) *Attorney, Agent, or Firm* — Manabu Kanesaka

(57) ABSTRACT

In the present invention, a digital electroacoustic transducer apparatus with a noise canceling system includes: a signal processing circuit that generates a digital processing signal based on a digital signal from a sound source; a first voice coil that receives the digital processing signal; a microphone that picks up noise and generates a noise signal; a noise canceling circuit that generates a cancel signal based on the noise signal; and a second voice coil that receives the cancel signal, the first voice coil and the second voice coil driving a diaphragm, thereby avoiding a difference between the phase of the cancel signal and the phase opposite to that of noise.

12 Claims, 5 Drawing Sheets

DIGITAL ELECTROACOUSTIC TRANSDUCER APPARATUS

RELATED APPLICATIONS

The present application is based on, and claims priority from, Japanese Application No. JP2017-221413 filed Nov. 17, 2017, the disclosure of which is hereby incorporated by reference herein in its entirety.

TECHNICAL FIELD

The present invention relates to a digital electroacoustic transducer apparatus.

BACKGROUND ART

In recent years, musical sound reproducing apparatuses having a function of outputting audio signals as digital signals have been widely adopted. A digital signal from such a musical sound reproducing apparatus is converted to sound waves, for example, by an electroacoustic transducer apparatus (hereinafter referred to as "digital electroacoustic transducer apparatus") that can output desired sound waves according to a digital signal (see Japanese Patent Laid-Open No. 2015-065661, for example).

Examples of such digital electroacoustic transducers apparatus include speakers installed indoors, and earphones and headphones worn over a user's ears (head).

The digital electroacoustic transducer apparatus includes a dynamic drive unit and a signal processing circuit for generating processing signals based on digital signals from a sound source. The drive unit includes a diaphragm and a plurality of voice coils. Each voice coil is driven with a processing signal generated in the signal processing circuit. Consequently, the digital electro-acoustic transducer efficiently generates sound at high to low frequencies based on audio signals.

A known electroacoustic transducer apparatus that converts audio signals to sound waves includes a system for canceling noise in the external environment (hereinafter referred to as an "NC system").

An electroacoustic transducer apparatus including the NC system includes a microphone and a noise canceling circuit (hereinafter referred to as an "NC circuit"). The microphone picks up noise around the electroacoustic transducer apparatus and generates a noise signal. The NC circuit generates a cancel signal according to the noise signal generated by the microphone. The cancel signal is a signal acoustically opposite in phase to the noise signal. The electroacoustic transducer apparatus generates sound waves based on a synthesized signal generated by synthesizing the cancel signal and an audio signal. Consequently, noise is acoustically canceled out with sound waves generated based on the synthesized signal through the electroacoustic transducer apparatus, and is thus canceled.

When such an NC system is mounted in a digital electroacoustic transducer apparatus, signal processing, such as generation of a cancel signal and synthesis of a cancel signal and an audio signal, is executed, for example, through digital processing using a digital signal processor (DSP) (see Japanese Patent Laid-Open No. 2017-098993).

The NC system disclosed in Japanese Patent Laid-Open No. 2017-098993 executes generation of a cancel signal and generation of a synthesized signal through a single DSP. Therefore, the NC system can generate an appropriate cancel signal depending on the type of noise.

Generating a cancel signal through digital processing using a DSP increases the time required for generating the cancel signal according to the amount of computation in the DSP to delay in time. Consequently, the phase of the cancel signal is not opposite to the phase of noise to be canceled, and is delayed by a phase corresponding to the time delayed with respect to the phase opposite to that of the noise, causing a phase difference between the cancel signal and the phase opposite to that of the noise.

In addition, when a synthesized signal is generated by digital processing using an adder circuit (mixer) included in the DSP, the phase of the synthesized signal (cancel signal) varies depending on the phase characteristics of the adder circuit. Consequently, the phase of the cancel signal is not opposite to the phase of the noise to be canceled but is shifted by the phase change from the opposite phase, causing a phase difference between the cancel signal and the phase opposite to that of noise.

Thus, if a phase difference occurs between the cancel signal and the phase opposite to that of the noise, the cancel signal cannot cancel the noise sufficiently by canceling it out.

SUMMARY OF THE INVENTION

An object of the present invention, which has been made to solve such a conventional problem, is to provide a digital electroacoustic transducer apparatus including an NC system with a suppressed phase difference between a cancel signal and the phase opposite to that of noise.

A digital electroacoustic transducer apparatus according to the present invention includes: a signal processing circuit that generates a digital processing signal based on a digital signal from a sound source; a first voice coil that receives the digital processing signal; a microphone that picks up noise and generates a noise signal; a noise canceling circuit that generates a cancel signal based on the noise signal; a second voice coil that receives the cancel signal; and a diaphragm to which the first voice coil and the second voice coil are attached.

The present invention can provide a digital electroacoustic transducer apparatus including an NC system with a suppressed phase difference between a cancel signal and the phase opposite to that of noise.

BRIEF DESCRIPTION THE DRAWINGS

DETAILED DESCRIPTION

Embodiments of the digital electroacoustic transducer apparatus (hereinafter referred to as "the present apparatus") according to the present invention will now be described with reference to the accompanying drawings.

The present apparatus is a digital electroacoustic transducer apparatus, such as a speaker, headphones, and earphones, that outputs sound waves based on audio signals (digital signals) from a sound source, such as a portable music sound reproducer. In the following description, the present apparatus will be described by taking headphones as an example.

Figure 1:
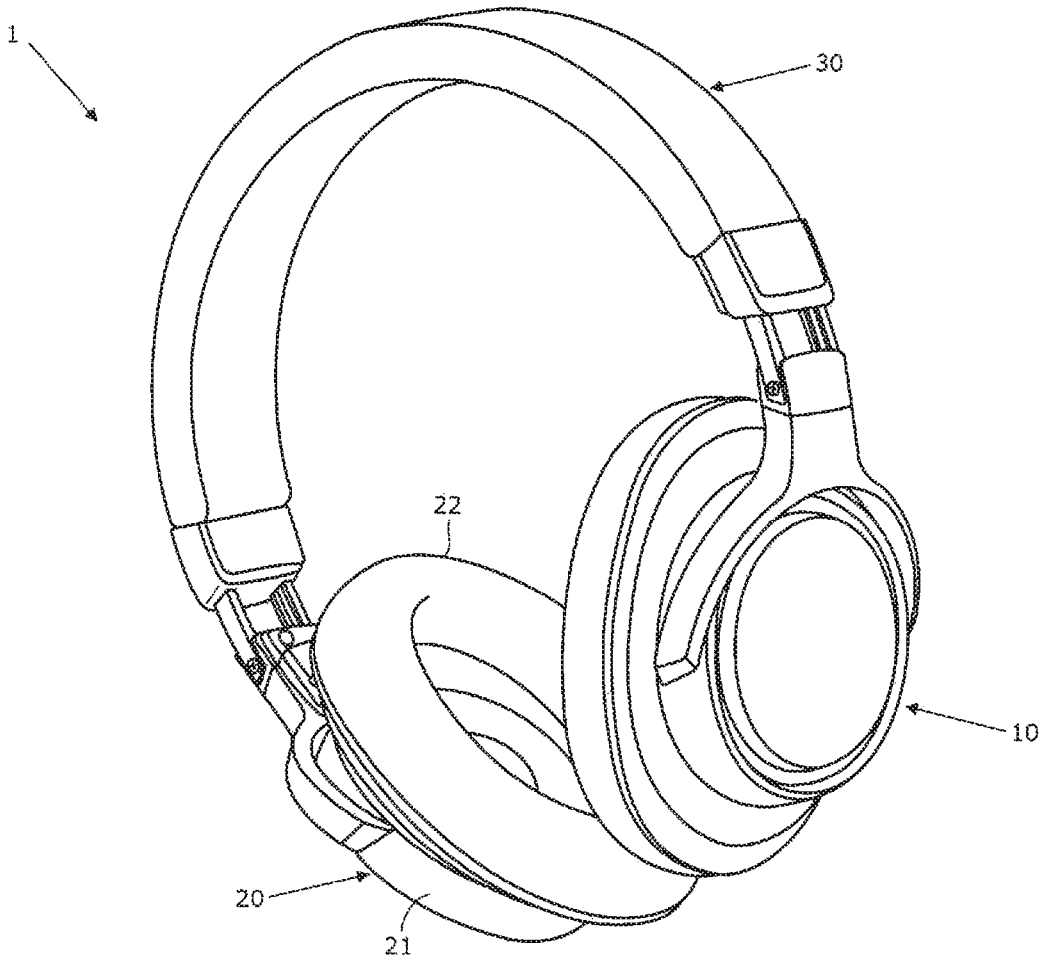
FIG. 1 is a perspective view showing an embodiment of a digital electroacoustic transducer apparatus according to the present invention.
Figure 2:
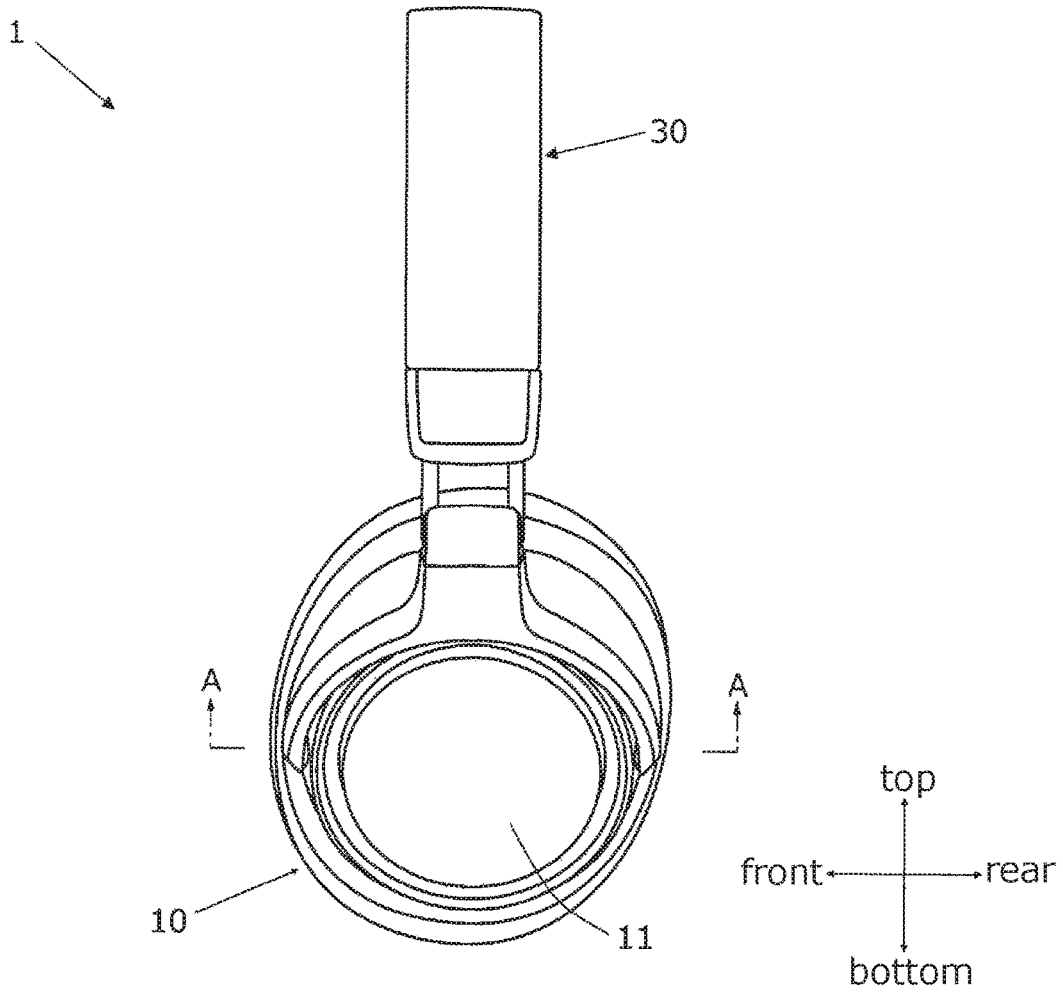
FIG. 2 is a left side view showing the digital electroacoustic transducer apparatus shown in FIG. 1.

Referring to the perspective view of FIG. 1 and the left side view of FIG. 2, this present apparatus 1 is worn on the head of a user of the present apparatus 1 and outputs sound waves based on an audio signal (digital signal) from a sound source. The present apparatus 1 is wired headphones to which audio signals from the sound source are input via, for example, a universal serial bus (USB) cable (not shown in the drawing).

Note that the present apparatus may be wireless headphones that receive audio signals from a sound source, using wireless transmission such as Bluetooth (registered trademark), for example.

In the following description, the directions of the top and bottom, left and right, and front and rear of the present apparatus 1 are the same as the directions of the top and bottom, left and right, and front and rear of the user wearing the present apparatus 1.

The present apparatus 1 includes a first sound output unit 10, a second sound output unit 20, and a connecting member 30. The first sound output unit 10 will be described later.

The second sound output unit 20 is worn around the right ear of the user, and outputs sound waves based on audio signals from the sound source. The configuration of the second sound output unit 20 is common to the configuration of the first sound output unit 10 except that it does not include a signal processing circuit, which will be described later.

In other words, the second sound output unit 20 includes a housing 21, an earpad 22, an input unit (not shown in the drawing), a sound pickup unit (not shown in the drawing), a noise canceling circuit (not shown in the drawing), and a drive unit (not shown in the drawing).

The connecting member 30 connects the first sound output unit 10 and the second sound output unit 20 to each other.

Figure 3:
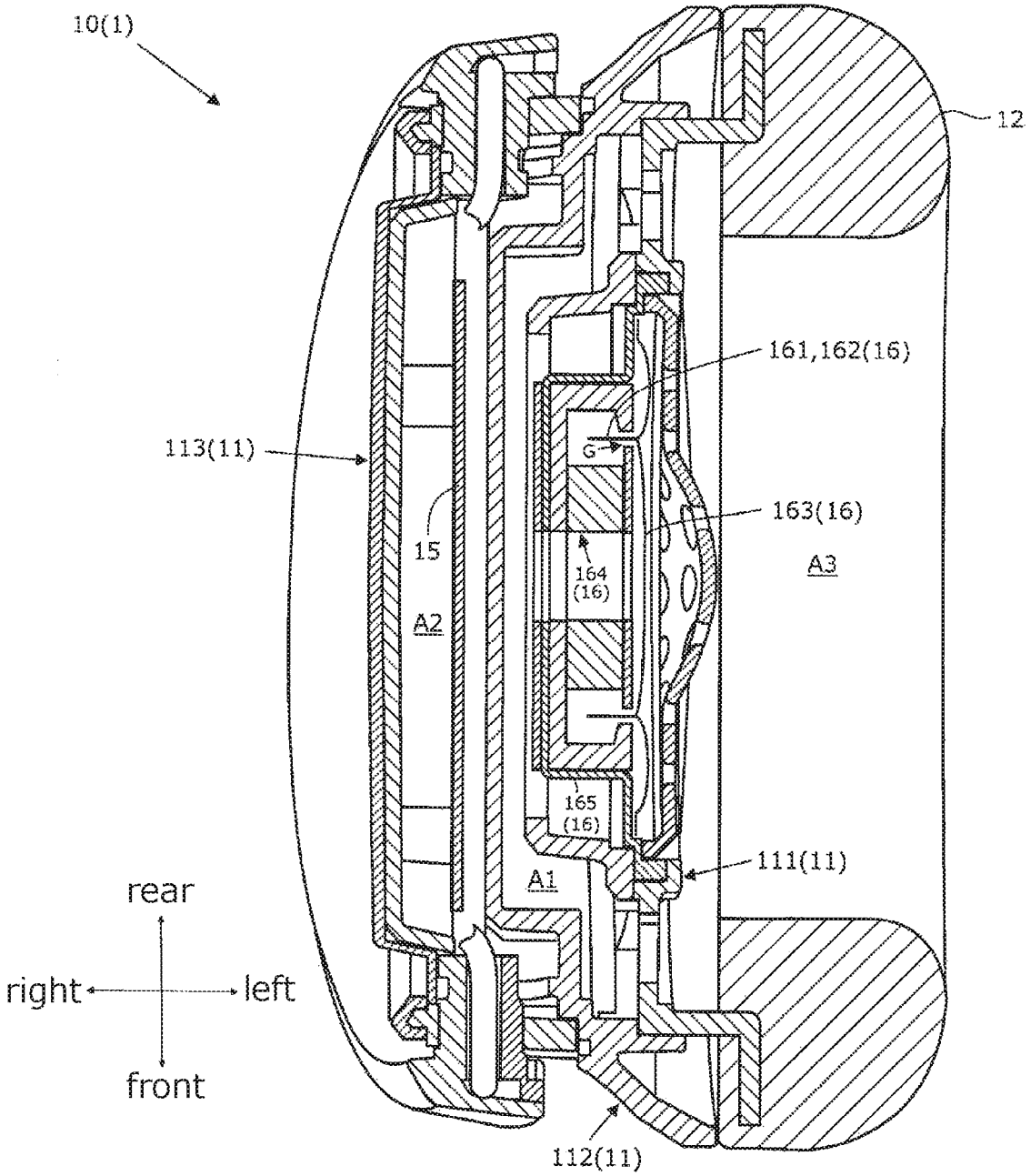
FIG. 3 is a cross-sectional view along line A-A showing a first sound output unit included in the digital electroacoustic transducer apparatus shown in FIG. 2.
Figure 4:
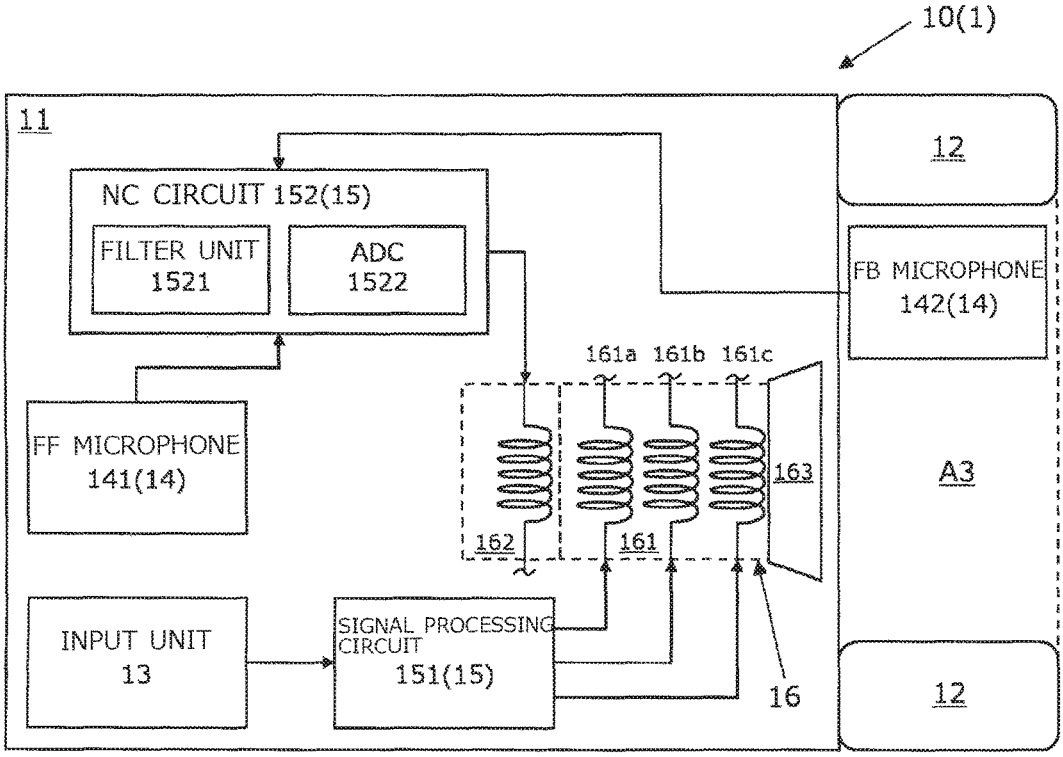
FIG. 4 is a schematic view showing a configuration of the first sound output unit shown in FIG. 3.

Referring to FIG. 3 and FIG. 4, the first sound output unit 10 is worn around the left ear of the user, and outputs sound waves based on audio signals from the sound source. The first sound output unit 10 includes a housing 11, an earpad 12, an input unit 13, a sound pickup unit 14, a circuit board 15, and a drive unit 16.

The housing 11 contains the input unit 13, the circuit board 15, and the drive unit 16. The housing 11 includes a baffle plate 111, a first housing 112, and a second housing 113.

The baffle plate 111 holds the drive unit 16. The first housing 112 defines a first accommodating chamber A1 for accommodating the drive unit 16, together with the baffle plate 111. The second housing 113 defines a second accommodating chamber A2 for accommodating the circuit board 15, together with the first housing 112.

The earpad 12 is a cushioning material between the housing 11 and the user's head. When the present apparatus 1 is worn on the user's head, the earpad 12 forms a closed space (hereinafter referred to as a "front air chamber") A3 between the housing 11 and the user's head.

The input unit 13 is a terminal for digital signals such as a USB terminal, for example. Audio signals from the sound source are input to the input unit 13 via the USB cable. Audio signals input to the input unit 13 are digital signals.

The sound pickup unit 14 picks up noise outside the housing 11 and generates a noise signal. The sound pickup unit 14 includes a feedforward microphone (hereinafter referred to as an "FF microphone") 141 and a feedback microphone (hereinafter referred to as an "FB microphone") 142.

"Noise" is a sound that reaches the housing 11 or the front air chamber A3 from a sound source different from a sound source such as a portable music sound reproducer.

The FF microphone 141 picks up noise outside the housing 11 and generates a first noise signal. The FF microphone 141 is a first microphone of the present invention. The FF microphone 141 is disposed, for example, in the second accommodating chamber A2.

The FB microphone 142 picks up, from noise outside the housing 11, noise entering the front air chamber A3 via the earpad 12 and sound waves (sound) output from the drive unit 16 to the front air chamber A3, and generates a second noise signal. In other words, the second noise signal includes a noise component and a sound component.

The FB microphone 142 is a second microphone of the present invention. The FB microphone 142 is, for example, attached to the baffle plate 111 and disposed in the front air chamber A3.

Note that the FB microphone of the present invention may be disposed in the housing (first accommodating chamber) as long as it can pick up noise entering the front air chamber.

The circuit board 15 is populated with a circuit required for the operation of the present apparatus 1, which will be described later. The circuit board 15 includes a signal processing circuit 151 and an NC (noise canceling) circuit 152. The circuit board 15 is disposed in the second accommodating chamber A2.

The signal processing circuit 151 processes an audio signal from the sound source in the state where it is a digital signal, and generates a digital processing signal for oscillating a diaphragm 163, which will be described later, according to the audio signal. The signal processing circuit 151 is a DSP, for example.

A "digital processing signal" is, for example, a digital signal obtained by applying a pulse-density modulation (PDM) process to an audio signal. The digital processing signal is transmitted to the drive unit 16 and the drive unit (not shown in the drawing) of the second sound output unit 20 via a cable (not shown in the drawing). The digital processing signal is applied to a first voice coil 161 described later.

The NC circuit 152 generates a cancel signal based on a noise signal (a first noise signal from the FF microphone 141 and a second noise signal from the FB microphone 142) from the sound pickup unit 14.

The NC circuit 152 includes a filter unit 1521 for processing a noise signal in the state where it is an analog signal, and an analog-to-digital converter (hereinafter referred to as an "ADC") 1522 for converting a signal processed by the filter unit 1521 to a digital signal. The filter unit 1521 is a known filter that extracts noise components from the noise signal and inverts its phase (makes it opposite in phase).

The "cancel signal" is a digital signal for vibrating the diaphragm 163, which will be described later, so as to cancel out (cancel) noise entering the front air chamber A3. The cancel signal is transmitted to the drive unit 16. The cancel signal is applied to a second voice coil 162 described later.

The drive unit 16 generates sound waves based on the digital processing signal and the cancel signal and outputs the sound waves to the front air chamber A3. The drive unit 16 is attached to a baffle plate 111 and is disposed in the first accommodating chamber A1. The drive unit 16 includes the first voice coil 161, the second voice coil 162, the diaphragm 163, a magnetic circuit 164, and a unit case 165.

The first voice coil 161 is driven by a digital processing signal from the signal processing circuit 151 and vibrates the diaphragm 163 in accordance with the digital processing signal. In this embodiment, the first voice coil 161 includes a plurality of (three) individual first voice coils 161*a*, 161*b*, and 161*c*.

A digital processing signal applied to the first voice coil 161 includes a plurality of (three in this embodiment) individual digital processing signals corresponding to the plurality of individual first voice coils 161*a* to 161*c*. The individual digital processing signals are applied to the respective individual first voice coils 161*a* to 161*c*.

The individual first voice coils 161*a* to 161*c* are driven by the individual digital processing signals, which are different from each other, and vibrate the diaphragm 163 in accordance with the individual digital processing signals.

The second voice coil 162 is driven by a cancel signal from the NC circuit 152 and vibrates the diaphragm 163 in accordance with the cancel signal.

The individual first voice coils 161*a* to 161*c* and the second voice coil 162 are attached to the right surface of the diaphragm 163 (the surface on the left side in FIG. 3) and are wound around a voice coil bobbin (not shown in the drawing) disposed in a magnetic gap G of the magnetic circuit 164. In other words, the first voice coil 161 and the second voice coil 162 are attached to a common diaphragm, i.e., the diaphragm 163.

In this case, the second voice coil 162 is attached to the diaphragm 163 in the state where it is twisted together with the first voice coil 161. Therefore, even if a digital signal containing a harmonic component is applied to the first voice coil 161 and the second voice coil 162, the skin effect hardly occurs and the reproducibility of high frequency does not deteriorate for audio signals from the sound source.

Note that the first voice coil and the second voice coil may be bundled, stacked in multiple layers concentrically, or arranged side by side in the left-right direction (the left-right direction in FIG. 3).

The diaphragm 163 is driven by the first voice coil 161 and the second voice coil 162 and thus vibrates, and generates and outputs sound waves. The diaphragm 163 is attached to the unit case 165. The diaphragm 163 can vibrate with respect to the unit case 165.

The magnetic circuit 164 generates a magnetic field. The magnetic circuit 164 includes a magnetic gap G that the magnetic flux passes at a uniform density. The first voice coil 161 and the second voice coil 162 are disposed in the magnetic gap G so as to cross the magnetic flux. The first voice coil 161 vibrates with respect to the magnetic circuit 164 through the electromagnetic force generated by the digital processing signal applied to the first voice coil 161.

The second voice coil 162 vibrates with respect to the magnetic circuit 164 through the electromagnetic force generated by the cancel signal applied to the second voice coil 162. Consequently, the diaphragm 163 generates sound waves that are a mixture of sound waves for canceling out (canceling) the noise in the front air chamber A3 and sound waves corresponding to audio signals from a sound source, and outputs them to the front air chamber A3.

The unit case 165 contains the first voice coil 161, the second voice coil 162, the diaphragm 163, and the magnetic circuit 164. The unit case 165 is attached to a right surface of the baffle plate 111 (the surface on the left side in FIG. 3).

Next, the operation of the present apparatus 1 will be described with reference to FIG. 4, taking the operation of the first sound output unit 10 as an example.

Audio signals from a sound source (not shown in the drawing) are input to the signal processing circuit 151 via the input unit 13. The signal processing circuit 151 generates digital processing signals, i.e., a plurality of individual digital processing signals based on audio signals that are digital signals. The individual digital processing signals are amplified by a digital amplifier (not shown in the drawing) and are applied to the respective individual first voice coils 161*a* to 161*c*.

Noise outside the housing 11 is picked up by the FF microphone 141. The FF microphone 141 generates a first noise signal based on the picked up noise. The first noise signal is input to the NC circuit 152.

On the other hand, out of the noise outside the housing 11, the noise entering the front air chamber A3 through the earpad 12 is picked up by the FB microphone 142. At this time, the FB microphone 142 also picks up the sound output from the drive unit 16 to the front air chamber A3. The FB microphone 142 generates a second noise signal based on the picked up noise and sound. The second noise signal is input to the NC circuit 152.

The NC circuit 152 generates a first cancel signal based on the first noise signal. The first cancel signal is a signal opposite in phase to the first noise signal. The NC circuit 152 generates a second cancel signal based on the second noise signal. The second cancel signal is a signal opposite in phase to the second noise signal and is a signal obtained by extracting the noise components from (removing (suppressing) the sound components from (in)) the second noise signal.

The NC circuit 152 generates a cancel signal by converting a signal, which is generated by adding the first cancel signal and the second cancel signal together, to a digital signal. The cancel signal is amplified by a digital amplifier (not shown in the drawing) and is applied to the second voice coil 162.

The generation of a cancel signal by the NC circuit 152 is analog processing that does not involve digital processing by a DSP or the like. Accordingly, the present apparatus 1 requires less time to generate a cancel signal than a conventional electro-acoustic transducer (hereinafter referred to as a "conventional apparatus") that generates a cancel signal by digital processing through a DSP. In other words, the cancel signal generated by the present apparatus 1 is less delayed than the cancel signal generated by the conventional apparatus.

The first voice coil 161 vibrates with the electromagnetic force generated through a relationship between the applied digital processing signal and the magnetic flux in the magnetic gap G (see FIG. 3). On the other hand, the second voice coil 162 vibrates with the electromagnetic force generated through a relationship between the applied cancel signal and the magnetic flux in the magnetic gap G.

Accordingly, the diaphragm 163 vibrates with the vibration of the first voice coil 161 and the vibration of the second voice coil 162. In other words, the vibration of the diaphragm 163 is a mixture of the vibration of the first voice coil 161 and the vibration of the second voice coil 162, and the digital processing signal and the cancel signal are mechanically synthesized in the diaphragm 163.

Thus, in the present apparatus 1, the digital processing signal and the cancel signal are synthesized directly in the diaphragm 163 without passing through the adder circuit. Hence, the cancel signal generated by the present apparatus 1 is not affected by the phase characteristics of the adder circuit. In other words, the phase of the cancel signal generated by the present apparatus 1 does not change between the NC circuit 152 and the second voice coil 162.

The sound waves output from the diaphragm 163 include a sound for canceling (suppressing) the noise entering the front air chamber A3 (hereinafter referred to as "cancel sound"). As described above, the cancel signal generated by the present apparatus 1 is less delayed from noise and does not change in phase.

In other words, the phase of the cancel sound output from the present apparatus 1 (the cancel signal generated by the present apparatus 1) has a smaller phase difference from the phase opposite to that of noise than the cancel sound output from the conventional apparatus (the cancel signal generated by the conventional apparatus). Consequently, the noise cancellation effect produced when the cancel sound output from the present apparatus 1 is acoustically coupled to the noise entering the front air chamber A3 is higher than in the conventional apparatus.

According to the embodiment described above, the present apparatus 1 includes the first voice coil 161 receiving the digital processing signal generated by the signal processing circuit 151, the second voice coil 162 receiving the cancel signal generated by the NC circuit 152, and the diaphragm 163 to which the first voice coil 161 and the second voice coil 162 are attached.

Accordingly, the cancel signal is generated by the NC circuit 152 and is applied to the second voice coil 162 without going through the signal processing circuit 151. Hence, the present apparatus 1 requires less time to generate the cancel signal than the conventional apparatus. In other words, the cancel signal generated by the present apparatus 1 is less delayed than the cancel signal generated by the conventional apparatus.

In addition, the digital processing signal generated by processing the audio signal is applied to the first voice coil 161, and the cancel signal generated by processing the noise signal is applied to the second voice coil 162. In other words, the cancel signal is applied to the second voice coil 162 without being electrically added to the digital processing signal by digital processing.

In other words, in the present apparatus 1, the digital processing signal and the cancel signal are synthesized directly in the diaphragm 163 without passing through the adder circuit. Hence, the cancel signal generated by the present apparatus 1 is not affected by the phase characteristics of the adder circuit. In other words, the phase of the cancel signal generated by the present apparatus 1 does not change.

Thus, the present apparatus 1 is less prone to a delay of the cancel signal or a change in the phase of the cancel signal than the conventional apparatus. In other words, the present apparatus 1 contributes to suppression of a difference between the phase of the cancel signal and the phase opposite to that of noise, compared with the conventional apparatus.

Further, according to the embodiment described above, the NC circuit 152 generates the first cancel signal and the second cancel signal by analog processing and adds them together. The NC circuit 152 generates a cancel signal by converting a signal, which is generated by adding the first cancel signal and the second cancel signal together, to a digital signal. Accordingly, the present apparatus 1 requires less time to generate the cancel signal than the conventional apparatus. In other words, the cancel signal generated by the present apparatus 1 is less delayed than the cancel signal generated by the conventional apparatus.

Further, according to the embodiment described above, the first voice coil 161 and the second voice coil 162 are disposed in the same magnetic gap G. In other words, both the magnetic circuit of the first voice coil 161 and the magnetic circuit of the second voice coil 162 are used as the magnetic circuit 164. Accordingly, the present apparatus 1 can be made smaller than the conventional apparatus.

Note that the present apparatus 1 according to the embodiment described above has a hybrid-type noise canceling function which is a combination of a feedforward canceling function and a feedback noise canceling function.

Alternatively, the present apparatus may have only the feedforward canceling function, or may have only the feedback noise canceling function. In other words, the present apparatus may include only the FF microphone, or may include only the FB microphone.

Further, the NC circuit of the present invention is not necessarily provided with an ADC. In other words, for example, the NC circuit may generate a cancel signal as an analog signal and apply the cancel signal to the second voice coil.

In addition, for the NC circuit in the present invention, the signal level of the first cancel signal may be different from the signal level of the second cancel signal. In other words, for the NC circuit in the present apparatus, a relative difference (level difference) between the two signal levels may be set. For example, for the NC circuit of the present invention, the level of the first cancel signal is set higher than the level of the second signal.

In this case, in the present apparatus, noise is canceled mainly by the feedforward canceling function, and the feedback noise canceling function is used as an aid of the feedforward canceling function. This suppresses the influence of the sound components that may be included in the second cancel signal on the first cancel signal, which will be described later.

In addition, the NC circuit according to the present invention may generate a second cancel signal solely for low-frequency noise. In other words, for example, in the NC circuit according to the present invention, a second cancel signal suppressing only noise with a frequency lower than that of the sound from the sound source may be generated.

In this case, the influence of the sound components that may be included in the second cancel signal on the first cancel signal, which will be described later, is suppressed. In addition, since the earpad has a passive noise canceling function for suppressing the noise with a middle-to-high frequency, the noise entering the front air chamber through the earpad is low-frequency noise. Therefore, the present apparatus provides an excellent noise cancellation effect while suppressing the influence of the sound components that may be included in the second cancel signal, on the first cancel signal, which will be described later.

Further, the number of individual first voice coils included in the first voice coil of the present invention is not limited to "3". In other words, the first voice coil of the present invention may include four individual first sound voice coils or a single individual first voice coil. Further, the second voice coil of the present invention may be composed of two individual second voice coils.

Figure 5:
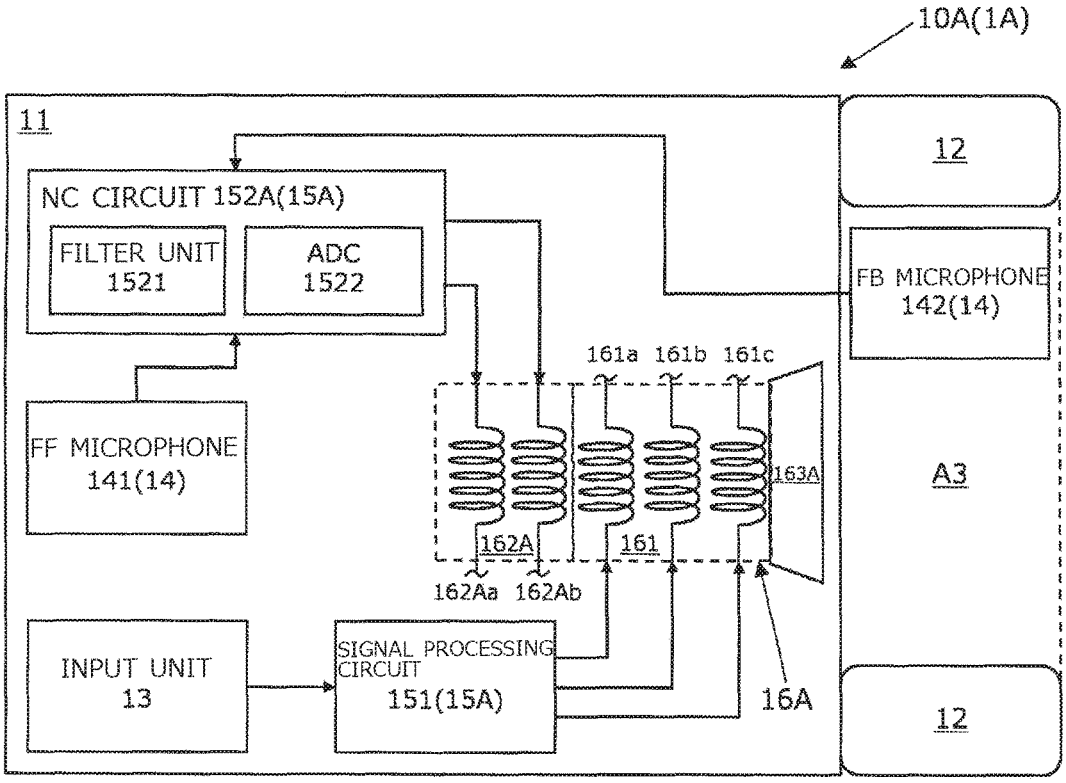
FIG. 5 is a schematic view showing another embodiment of a digital electroacoustic transducer apparatus according to the present invention.

FIG. 5 is a schematic view showing another embodiment of the present apparatus. The drawing schematically shows only the configuration of a first sound output unit 10A included in this present apparatus 1A. In the drawing, a member denoted by the same reference numeral as in another drawing has the same function as the corresponding member in the other drawing.

The present apparatus 1A is composed of the first sound output unit 10A. The first sound output unit 10A includes a housing 11, an earpad 12, an input unit 13, a sound pickup unit 14, a circuit board 15A, and a drive unit 16A.

The circuit board 15A is populated with a circuit required for the operation of the present apparatus 1A. The circuit board 15A includes a signal processing circuit 151 and an NC circuit 152A.

The NC circuit 152A generates a first cancel signal based on the first noise signal generated by the FF microphone 141 and also generates a second cancel signal based on the second noise signal generated by the FB microphone 142. The NC circuit 152A performs conversion to a digital signal without adding the first cancel signal and the second cancel signal together, and outputs the digital signal to the drive unit 16A.

The drive unit 16A includes a first voice coil 161, a second voice coil 162A, a diaphragm 163A, a magnetic circuit 164, and a unit case 165.

The second voice coil 162A is driven by the first cancel signal and the second cancel signal from the NC circuit 152A and vibrates the diaphragm 163A in accordance with the first cancel signal and the second cancel signal.

In this embodiment, the second voice coil 162A includes two individual second voice coils 162Aa and 162Ab. The individual second voice coil 162Aa is a first coil of the present invention, and the individual second voice coil 162Ab is a second coil of the present invention.

The first cancel signal is applied to the individual second voice coil 162Aa. The second cancel signal is applied to the individual second voice coil 162Ab. In other words, the individual second voice coil 162Aa is driven by the first cancel signal and vibrates the diaphragm 163A. The individual second voice coil 162Ab is driven by the second cancel signal and vibrates the diaphragm 163A.

Here, the present apparatus 1 according to the embodiment previously described adds the first cancel signal and the second cancel signal together through the NC circuit 152. Therefore, the first cancel signal is affected by the sound components that may be included in the second cancel signal (the sound components remaining without being removed by the NC circuit 152).

In contrast, the individual second voice coil 162Aa of the present apparatus 1A is driven by only the first cancel signal generated based on the signal from the FF microphone 141. Therefore, the individual second voice coil 162Aa is not affected by the sound components that may be included in the second cancel signal (the sound components remaining without being removed by the NC circuit 152A), i.e., by the sound picked up by the FB microphone 142 (the sound waves output from the diaphragm 163A to the front air chamber A3). Consequently, the present apparatus 1A achieves a noise cancellation effect faithful to the first cancel signal compared with the present apparatus 1 of the embodiment previously described.

The invention claimed is:

1. A digital electroacoustic transducer apparatus comprising:

a signal processing circuit that generates a digital processing signal based on a digital signal from a sound source;

a first voice coil that receives the digital processing signal;

a sound pickup unit that picks up noise and generates a noise signal, the sound pickup unit including a first microphone that generates a first noise signal, and a second microphone that generates a second noise signal;

a noise canceling circuit that generates a cancel signal based on the noise signal, the noise canceling circuit generating a first cancel signal based on the first noise signal and a second cancel signal based on the second noise signal, the cancel signal being obtained by adding the first cancel signal and the second cancel signal together;

a second voice coil that receives the cancel signal applied from the noise cancelling circuit; and a diaphragm to which the first voice coil and the second voice coil are attached, wherein the first microphone is a feedforward microphone, and the second microphone is a feedback microphone.

2. The digital electroacoustic transducer apparatus according to claim 1, wherein the noise canceling circuit comprises:

a filter unit for analog processing of the noise signal; and a converter that converts an analog signal produced by processing in the filter unit, to a digital signal.

3. The digital electroacoustic transducer apparatus according to claim 1, wherein the first voice coil comprises a plurality of individual first voice coils, the digital processing signal comprises a plurality of individual digital processing signals that are respectively different from each other, and the plurality of individual digital processing signals is applied to the respective individual first voice coils.

4. The digital electroacoustic transducer apparatus according to claim 1, wherein the first voice coil and the second voice coil are attached to the diaphragm in a state where the first voice coil and the second voice coil are twisted together.

5. The digital electroacoustic transducer apparatus according to claim 1, further comprising a magnetic circuit, wherein the magnetic circuit includes a magnetic gap, and the first voice coil and the second voice coil are disposed in the magnetic gap.

6. The digital electroacoustic transducer apparatus according to claim 1.

7. The digital electroacoustic transducer apparatus according to claim 1, wherein the first microphone picks up noise outside a housing, and the second microphone picks up noise and sound waves.

8. The digital electroacoustic transducer apparatus according to claim 7, wherein the first voice coil receiving the digital processing signal, and the second voice coil receiving the canceling signal including signals through the first microphone and the second microphone are arranged parallel to each other, and directly connected to the diaphragm to directly cancel the cancel signal at the diaphragm.

9. A digital electroacoustic transducer apparatus comprising:

a signal processing circuit that generates a digital processing signal based on a digital signal from a sound source;

a first voice coil that receives the digital processing signal;

a sound pickup unit that picks up noise and generates a noise signal, the sound pickup unit including a first microphone that generates a first noise signal, and a second microphone that generates a second noise signal;

a noise canceling circuit that generates a cancel signal based on the noise signal, the noise canceling circuit generating, as the cancel signal, a first cancel signal based on the first noise signal, and a second cancel signal based on the second noise signal;

a second voice coil that receives the cancel signal, and including a first coil to which the first cancel signal is applied, and a second coil to which the second cancel signal is applied; and a diaphragm to which the first voice coil and the first and second coils as the second voice coil are attached.

10. The digital electroacoustic transducer apparatus according to claim 9, further comprising a magnetic circuit, wherein the magnetic circuit includes a magnetic gap, and the first voice coil and the first and second coils are disposed in the magnetic gap.

11. The digital electroacoustic transducer apparatus according to claim 9, wherein the first microphone is a feedforward microphone, and the second microphone is a feedback microphone.

12. The digital electroacoustic transducer apparatus according to claim 9, wherein the first voice coil receiving the digital processing signal, the first coil and the second coil are arranged parallel to each other, and directly connected to the diaphragm to directly cancel the first and second cancel signals at the diaphragm.

* * * * *